US009068735B2

(12) United States Patent
Chang

(10) Patent No.: US 9,068,735 B2
(45) Date of Patent: Jun. 30, 2015

(54) MAGNETIC RETAINER WITH ILLUMINATION DEVICE

(71) Applicant: Man-Chi Chang, Taichung (TW)

(72) Inventor: Man-Chi Chang, Taichung (TW)

( * ) Notice: Subject to any disclaimer, the term of this patent is extended or adjusted under 35 U.S.C. 154(b) by 236 days.

(21) Appl. No.: 13/736,969

(22) Filed: Jan. 9, 2013

(65) Prior Publication Data

US 2013/0128597 A1 May 23, 2013

Related U.S. Application Data

(63) Continuation-in-part of application No. 13/296,248, filed on Nov. 15, 2011, now abandoned.

(51) Int. Cl.

| | |
|---|---|
| ***A45C 11/26*** | (2006.01) |
| ***B65D 85/28*** | (2006.01) |
| ***F21L 4/00*** | (2006.01) |
| ***F21V 21/14*** | (2006.01) |
| ***F21V 33/00*** | (2006.01) |
| ***F21V 21/30*** | (2006.01) |
| ***B25H 3/02*** | (2006.01) |
| *F21W 131/10* | (2006.01) |

(52) U.S. Cl.

CPC ..... *F21V 21/14* (2013.01); *F21V 33/008* (2013.01); *F21V 21/30* (2013.01); *F21W 2131/1005* (2013.01); *B25H 3/02* (2013.01)

(58) Field of Classification Search

CPC ..... B65H 3/06; B65H 3/023; A45C 13/02

USPC ..... 206/350, 818, 205, 207, 206, 234, 373; 211/88.01, 70.6, 126.1; 362/191; 248/206.5

See application file for complete search history.

(56) References Cited

U.S. PATENT DOCUMENTS

| | | | | |
|---|---|---|---|---|
| 4,691,470 | A * | 9/1987 | Landell et al. | 43/55 |
| 5,071,004 | A * | 12/1991 | Rivera | 206/373 |
| 5,459,648 | A * | 10/1995 | Courtney | 362/154 |
| 5,535,882 | A * | 7/1996 | Liu | 206/377 |
| 5,611,170 | A * | 3/1997 | McGuff et al. | 43/57.1 |
| 5,833,352 | A * | 11/1998 | Goodwin | 362/156 |
| 6,237,767 | B1 * | 5/2001 | Lee | 206/373 |
| 6,811,127 | B1 * | 11/2004 | Shiao | 248/206.5 |
| 7,055,983 | B1 * | 6/2006 | Baker et al. | 362/154 |
| 2003/0038100 | A1 * | 2/2003 | Liu | 211/88.01 |
| 2008/0179268 | A1 * | 7/2008 | Jang | 211/126.1 |
| 2013/0118936 | A1 * | 5/2013 | Chang | 206/350 |

* cited by examiner

*Primary Examiner* — Mickey Yu
*Assistant Examiner* — Chun Cheung

(57) ABSTRACT

A magnetic retainer includes a body, a magnetic member, a plate and a light unit. The body has a space for receiving objects and the magnetic member is connected to the bottom of the body to attract the objects. The plate has a concaved portion for receiving the objects and is rotatably connected to the body. When the light unit is rotated to a first position relative to the plate, the light emitting member faces outside of the plate. When the light unit is rotated to a second position relative to the plate, the light emitting member faces the concaved portion of the plate.

3 Claims, 7 Drawing Sheets

MAGNETIC RETAINER WITH ILLUMINATION DEVICE

RELATED APPLICATION

This application is a Continuation-in-Part of U.S. application Ser. No. 13/296,248, entitled "MAGNETIC CONTAINER", naming Man-Chi Chang as inventor, and filed on Nov. 15, 2011.

FIELD OF THE INVENTION

The present invention relates to a magnetic retainer, and more particularly, to a magnetic retainer for retaining parts thereon and the illumination device provides illumination when in use.

BACKGROUND OF THE INVENTION

The conventional magnetic retainer is disclosed in U.S. Pat. No. 6,811,127 and comprises an attraction space defined by the body, the inner surface, the peripheral wall and the frame wall of the body. The inner surface has an inside, an outside and position holes. The frame wall has a reception recess. The positioning holes and the reception recess respectively have a magnet which extends beyond the top of the frame wall so as to attract the positioning members. However, the inside of the body has the magnet for attracting metal articles, non-metallic articles such as plastic articles cannot be attracted and positioned so that when the device is connected to one side of a vehicle, the non-metallic articles such as plastic articles will drop. Besides, there is no illumination device connected to the retainer and the use of the retainer in dark area is inconvenient.

The present invention intends to provide a magnetic retainer for retaining parts thereon and the illumination device provides illumination when in use.

SUMMARY OF THE INVENTION

The present invention relates to a magnetic retainer and comprises a body, a magnetic member, a plate and a light unit. The body has a space for receiving objects and the magnetic member is connected to the bottom of the body to attract the objects. The plate has a concaved portion for receiving the objects and is rotatably connected to the body. When the light unit is rotated to a first position relative to the plate, the light emitting member faces outside of the plate. When the light unit is rotated to a second position relative to the plate, the light emitting member faces the concaved portion of the plate.

The primary object of the present invention is to provide a magnetic retainer with a light illumination unit.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figures 1, 2, 3:
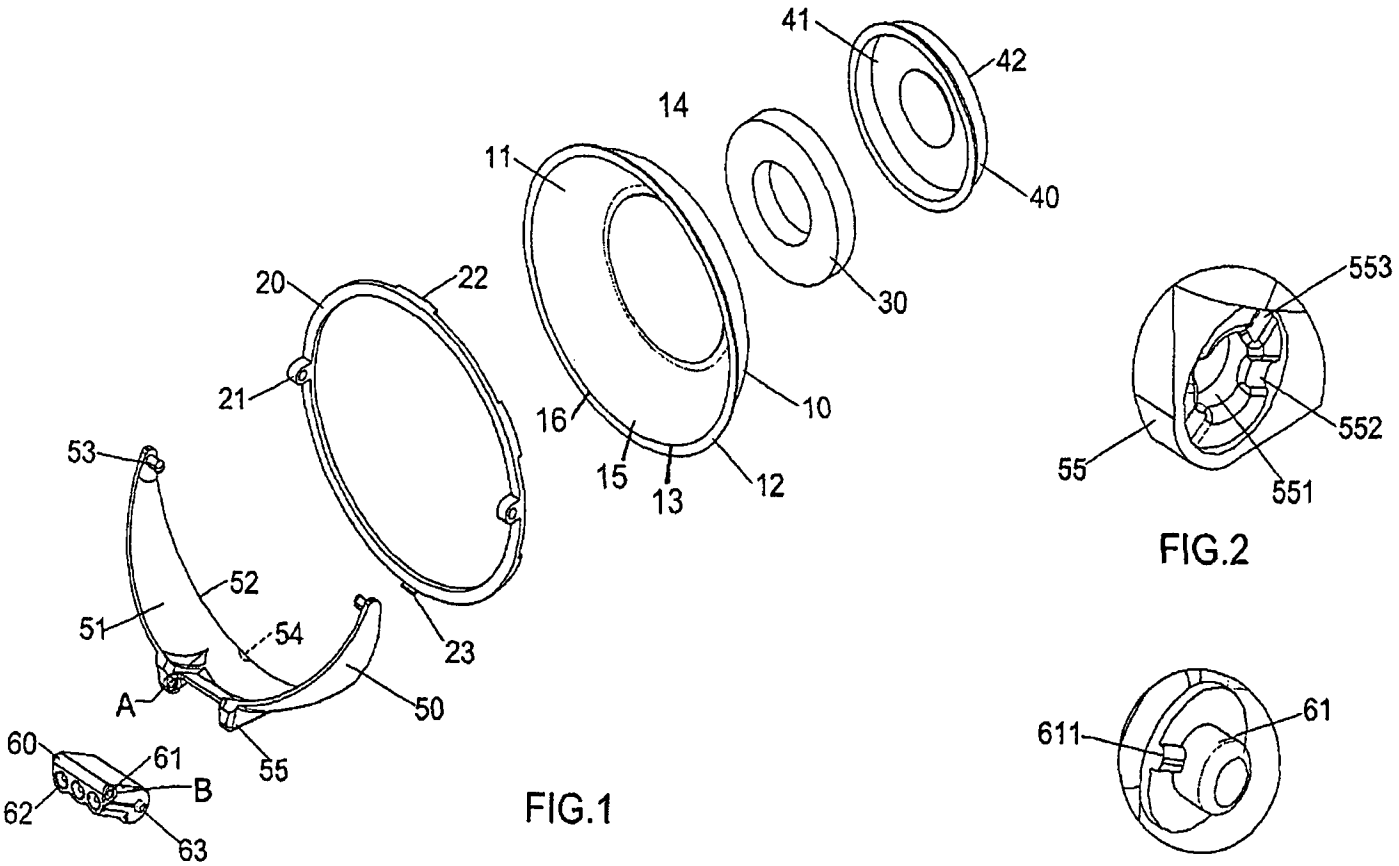
FIG. 1 is an exploded view to show the magnetic retainer of the present invention.
FIG. 2 is an enlarged view to show the circled portion designated by "A" in FIG. 1.
FIG. 3 is an enlarged view to show the circled portion designated by "B" in FIG. 1.

Referring to FIGS. 1 to 3, the magnetic retainer of the present invention comprises a magnetic retainer and comprises a body 10, a connection member 20, at least one magnetic member 30, a base 40, a plate 50 and a light unit 60.

The body 10 is a metal and bowl like body such as made by steel or iron, and has a top 13 and a bottom 14. A space 11 is defined in the body 10 and a lip 12 extends from the periphery 16 of the opening 15 located at the top 13 of the body 10.

Figure 4:
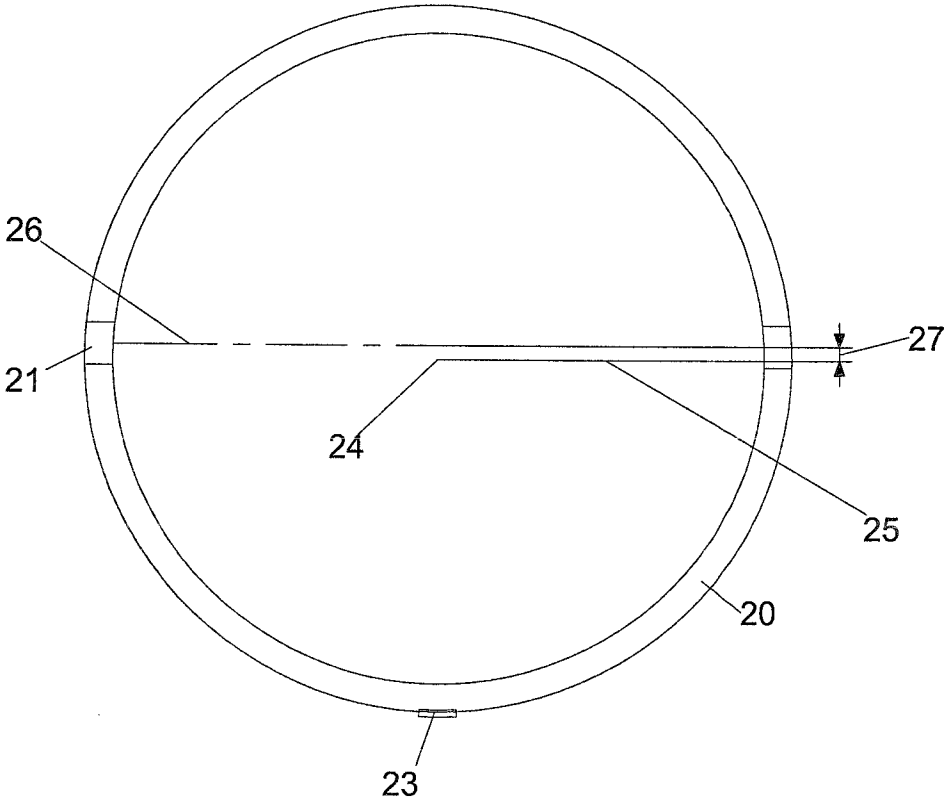
FIG. 4 is a front view of the connection member of the magnetic retainer of the present invention.

The connection member 20 is a ring-shaped member and made by plastic, rubber or metal. The connection member 20 has two first pivotal portions 21 on the common axis (the two first pivotal portions 21 are aligned coaxially), a locking portion 23 and a hook 22. The hook 22 hooks the lip 12 of the body 10 to connect the connection member 20 to the body 10. The locking portion 23 is located between the two first pivotal portions 21. As shown in FIG. 4, the connection member 20 has a center 24 from which a first horizontal line 25 perpendicularly extends. A second horizontal line 26 passes through the two first pivotal portions 21. The first and second horizontal lines 25, 26 are located on the same horizontal plane. A first distance 27 is defined between the first and second horizontal lines 25, 26. The second horizontal line 26 is located farer from the locking portion 23 than the first horizontal line 25, The magnetic member 30 is fixed to the bottom of the body 10 and located at the bottom of the space 11 so as to attract objects.

The base 40 has a reception portion 41 in which the magnetic member 30 is received, the bottom 42 of the base 40 is a rough surface so that the base 40 does not slip.

The plate 50 is a curved plate, and the plate 50 and the connection member 20 are made by the same material. The plate 50 has a front side and a rear side, the front side has a concaved portion 51 which is located corresponding to the space 11. The plate 50 has a contact edge 52 on one side thereof and two second pivotal portions 53 are respectively located at two ends of the contact edge 52. The two first pivotal portions 21 are pivotably connected to the two second pivotal portions 53. A protrusion 54 extends from the plate 50 and is locked with the locking portion 23 so that the contact edge 52 contacts the connection member 20. When the protrusion 54 is disengaged from the locking portion 23, the plate 50 is pivoted upward relative to the body 10. The plate 50 has two third pivotal portions 55 located on the rear side thereof, each of the third pivotal portions 55 has a recess 551. An end face of the third pivotal portion 55 has a first positioning portion 552 and a second positioning portion 553 located close to the recess 551. The first positioning portion 552 and the second positioning portion 553 are two respective slots.

The light unit 60 comprises a light emitting member 62 and a switch 63 which controls the light emitting member 62 to work. The light unit 60 is pivotably connected to the plate 50. Two fourth pivotal portions 61 are located on two sides of the light unit 60, an end face of the fourth pivotal portion 61 has a third positioning portion 611. The end face of the fourth pivotal portion 61 is pivotably matched with the end face of the third pivotal portion 55. When the third positioning portion 611 is engaged with the first positioning portion 552, the light emitting member 62 faces the outside of the plate 50. When the third positioning portion 611 is engaged with the second positioning portion 552, the light emitting member 62 faces the concaved portion 51.

As shown in FIGS. 5 to 8, when the light unit 60 is pivoted to a first position relative to the plate 50, the third positioning portion 611 is engaged with the first positioning portion 552, the light emitting member 62 faces outside of the plate 50 so as to provide illumination of the work site.

Figure 9:
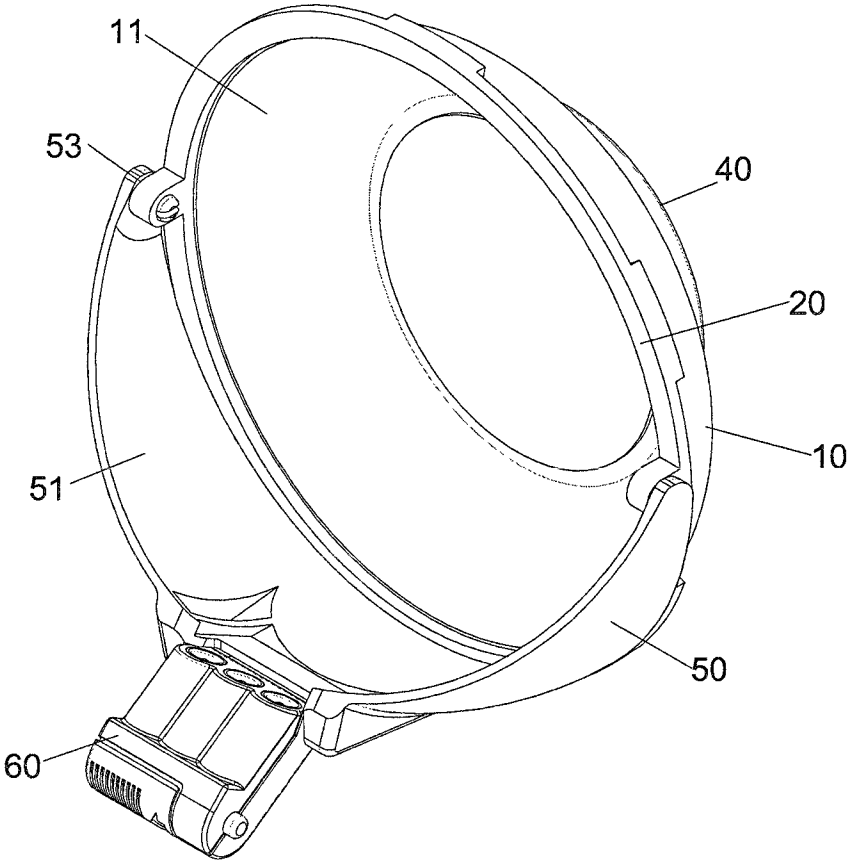
FIG. 9 shows the magnetic retainer of the present invention, wherein the light unit is located at the second position.

As shown in FIG. 9, when the light unit 60 is pivoted to a second position relative to the plate 50, the third positioning portion 611 is engaged with the second positioning portion 552, the light emitting member 62 faces the concaved portion 51 of the plate 50 and the space 11 of the body 10 so that the users can easily pick the objects in the space 11 and the concaved portion 51.

Figure 5:
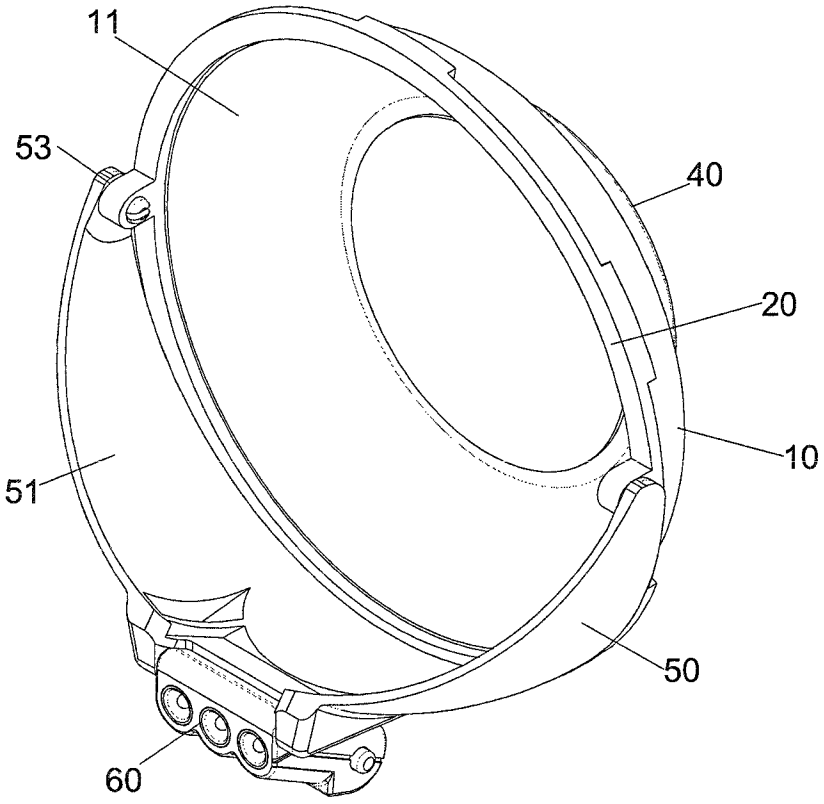
FIG. 5 is a perspective view to show the magnetic retainer of the present invention.
Figure 6:
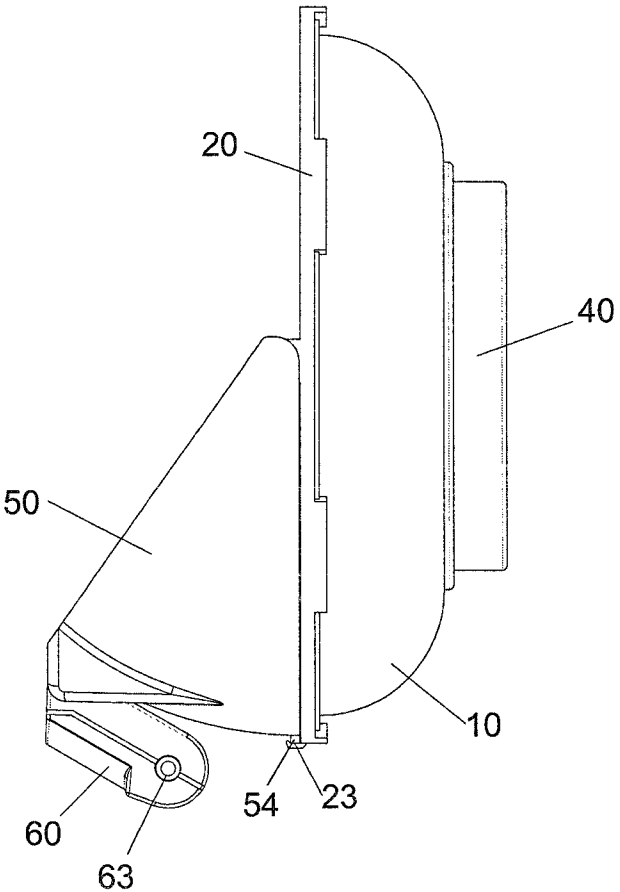
FIG. 6 is a side view of the magnetic retainer of the present invention.
Figure 8:
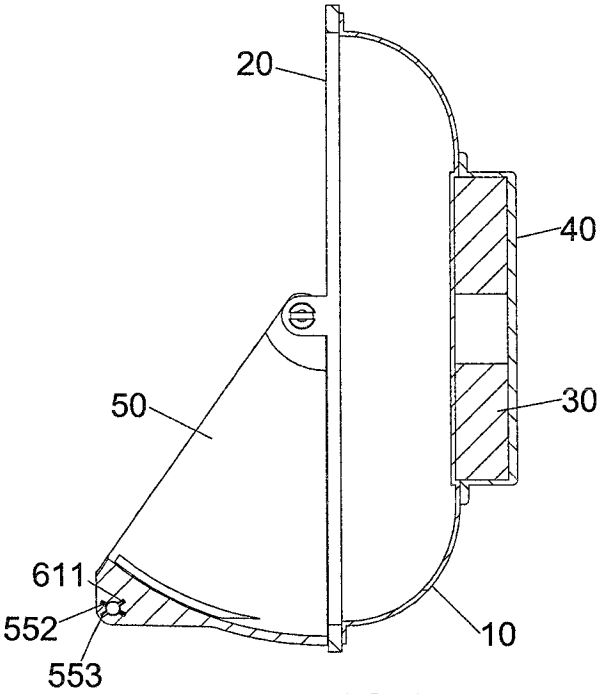
FIG. 8 is a cross sectional view, taken along line C-C in FIG. 7.
Figure 7:
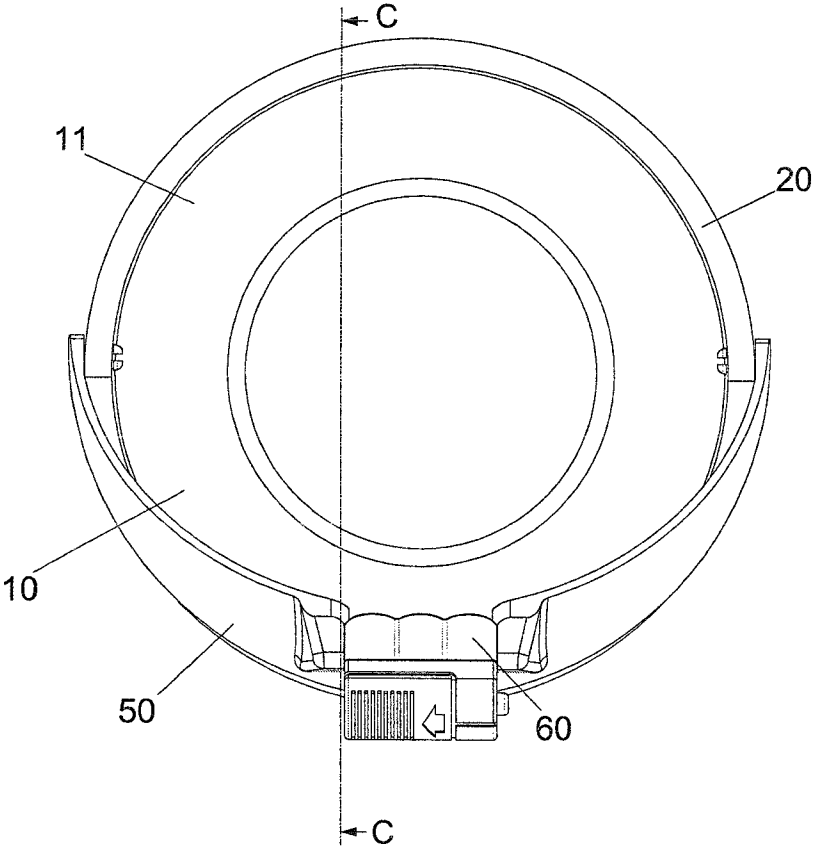
FIG. 7 is a front view of the magnetic retainer of the present invention.
Figure 10:
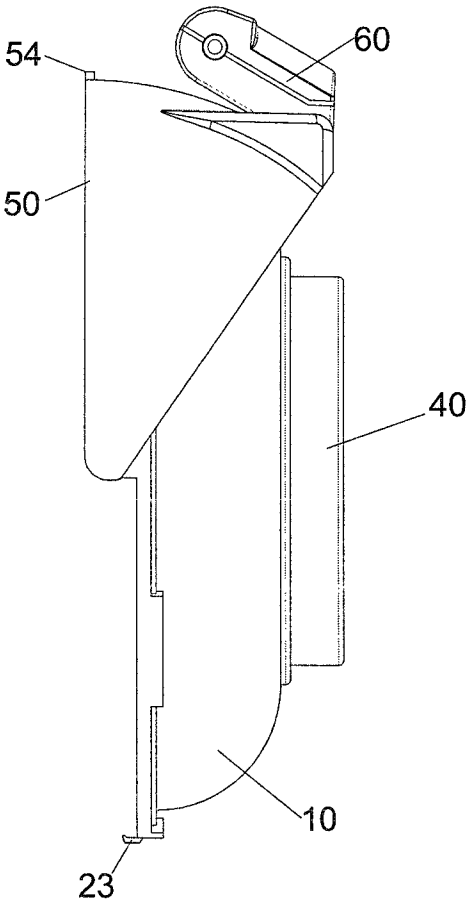
FIG. 10 is a side view of the magnetic retainer of the present invention, wherein the plate is folded.

As shown in FIGS. 2 and 10, the first distance 27 is defined between the first and second horizontal lines 25, 26, and the second horizontal line 26 is located farer from the locking portion 23 than the first horizontal line 25. The second pivotal portions 53 are engaged with the first pivotal portions 21. The protrusion 54 is engaged with the locking portion 23. As shown in FIG. 5, when the protrusion 54 is disengaged from the locking portion 23, the plate 50 is pivotable over the lip 12 and located at outside of the body 10.

In one embodiment, there are multiple magnetic members 30 which are connected to the bottom of the body 10 in the form of multiple circles. The number of the space 11 is the same as that of the magnetic member 30. Each space 11 receives one magnetic member 30. In another embodiment, the connection member 20 and the body 10 are integrally manufactured.

There are advantages of the present invention:

The light unit 60 provides illumination to the work site when the light unit 60 is pivoted to the first position relative to the plate 50, and the third positioning portion 611 is engaged with the first positioning portion 552.

The light unit 60 provides illumination to the users so that the users can easily pick the objects in the space 11 and the concaved portion 51 when the light unit 60 is pivoted to the second position relative to the plate 50, the third positioning portion 611 is engaged with the second positioning portion 552, and the light emitting member 62 faces the concaved portion 51 of the plate 50 and the space 11 of the body 10.

When the protrusion 54 is disengaged from the locking portion 23, the plate 50 is pivotable over the lip 12 and located at outside of the body 10. This status is benefit for storage.

The metallic objects can be attracted by the magnetic member 30 when put in the space 11 of the body 10. Non-metal objects can be stored in the concaved portion 51.

The third pivotal portions 55 and the light unit 60 are located on the outside of the plate 50, so that when the plate 50 is stored as shown in FIG. 10, the pivotal action of the plate 50 is not affected by the light unit 60.

While we have shown and described the embodiment in accordance with the present invention, it should be clear to those skilled in the art that further embodiments may be made without departing from the scope of the present invention.

What is claimed is:

1. A magnetic retainer comprising:

a body having a top and a bottom, a space defined in the body;

at least one magnetic member fixed to the bottom of the body and located at a bottom of the space;

a plate having a front side and a rear side, the front side having a concaved portion which is located corresponding to the space, the plate pivotably connected to the body;

a light unit having a light emitting member and a switch, the light unit pivotably connected to the plate, when the light unit is pivoted to a first position relative to the plate, the light emitting member faces outside of the plate, when the light unit is pivoted to a second position relative to the plate, the light emitting member faces the concaved portion of the plate, and the plate being connected to the body by a connection member, a lip extending from a periphery of an opening located at the top of the body, the connection member being a ring-shaped member and having two first pivotal portions on a common axis, a locking portion and a hook, the hook hooking the lip of the body, the locking portion being located between the two first pivotal portions, the connection member having a center from which a first horizontal line extends, a second horizontal line passing through the two first pivotal portions, a first distance being defined between the first and second horizontal lines, the second horizontal line being located farer from the locking portion than the first horizontal line, the plate being a curved plate and having a contact edge on one side thereof and two second pivotal portions being respectively located at two ends of the contact edge, the two first pivotal portions being pivotably connected to the two second pivotal portions, a protrusion extending from the plate and being locked with the locking portion, the plate having two third pivotal portions located on the rear side thereof, each of the third pivotal portions having a recess, an end face of the third pivotal portion having a first positioning portion and a second positioning portion being located close to the recess, the first positioning portion and the second positioning portion being two respective slots, the switch of the light unit controlling the light emitting member, two fourth pivotal portions being located on two sides of the light unit, an end face of the fourth pivotal portion having a third positioning portion, the second end face of the fourth pivotal portion being pivotably matched with the end face of the third pivotal portion; when the third positioning portion being engaged with the first positioning portion, the light emitting member facing outside of the plate, when the third positioning portion being engaged with the second positioning portion, the light emitting member facing the concaved portion.

2. The magnetic retainer as claimed in claim 1, wherein the at least one magnetic member is connected to the bottom of the body and a base is connected to the bottom of the body, the base has a reception portion in which the at least one magnetic member is received, the bottom of the base is a rough surface.

3. The magnetic retainer as claimed in claim 1, wherein the plate and the connection member are made by the same material.

* * * * *